US006769841B2

(12) United States Patent
Moulin et al.

(10) Patent No.: US 6,769,841 B2
(45) Date of Patent: Aug. 3, 2004

(54) METHOD FOR DRIVING SHEET PILES

(75) Inventors: Jean-Michel Moulin, Saint-Julien-lès-Metz (FR); André Rix, Messancy (BE)

(73) Assignee: International Sheet Piling Company Sarl, Esch sur Alzette (LU)

( * ) Notice: Subject to any disclaimer, the term of this patent is extended or adjusted under 35 U.S.C. 154(b) by 0 days.

(21) Appl. No.: 10/239,900

(22) PCT Filed: Mar. 19, 2001

(86) PCT No.: PCT/EP01/03123

§ 371 (c)(1),
(2), (4) Date: Sep. 26, 2002

(87) PCT Pub. No.: WO01/73209

PCT Pub. Date: Oct. 4, 2001

(65) Prior Publication Data

US 2003/0053869 A1 Mar. 20, 2003

(30) Foreign Application Priority Data

Mar. 29, 2000 (LU) ..... 90557

(51) Int. Cl.[7] ..... E02D 5/02; E02D 5/14
(52) U.S. Cl. ..... 405/279; 405/274; 52/2.13
(58) Field of Search ..... 405/274–281; 52/2.11, 2.13

(56) References Cited

U.S. PATENT DOCUMENTS

| | | | | | |
|---|---|---|---|---|---|
| 3,064,320 | A | * | 11/1962 | Blaszkowski | 52/2.12 |
| 3,807,100 | A | * | 4/1974 | Kuss | 52/2.11 |
| 3,886,709 | A | * | 6/1975 | Krah et al. | 52/460 |
| 3,969,862 | A | * | 7/1976 | Kuss | 52/404.1 |
| 5,782,583 | A | | 7/1998 | Vales | 405/281 |
| 6,317,477 | B1 | * | 11/2001 | Matteson | 376/203 |

FOREIGN PATENT DOCUMENTS

| | | | |
|---|---|---|---|
| EP | 0466531 | A | 1/1992 |
| EP | 0628662 | A | 12/1994 |
| FR | 2267499 | A | 11/1975 |
| GB | 2322658 | A | 9/1998 |

* cited by examiner

*Primary Examiner*—Robert E. Pezzuto
*Assistant Examiner*—Tara L. Mayo
(74) *Attorney, Agent, or Firm*—McCormick, Paulding & Huber LLP

(57) ABSTRACT

A method for driving a sheet pile wall into the ground includes providing a sheet pile with at least one sheet pile interlock having a longitudinal opening giving access to an interlock chamber in the sheet pile interlock. The method further includes inserting an inflatable tube device in the interlock chamber, inflating the inflatable tube so that the inflatable tube closes the longitudinal opening, driving the sheet pile into the ground, deflating the inflatable tube and withdrawing the inflatable tube from the interlock device.

20 Claims, 4 Drawing Sheets

METHOD FOR DRIVING SHEET PILES

FIELD OF THE INVENTION

The present invention relates to a method for driving sheet piles into the ground.

BACKGROUND OF THE INVENTION

The use of sheet piles for constructing retaining walls is well known. The sheet piles used in such walls have sheet pile interlocks along their longitudinal edges, which can be interlocked so as to maintain the longitudinal edges of adjacent sheet piles interconnected with each other. Current sheet pile interlocks of the double-hook interlock type (type 1 according to EN10248 norm), as e.g. LARSSEN type sheet pile interlocks, are hook shaped elements with an internal interlock chamber. A sheet pile wall is formed by driving a first sheet pile into the ground, introducing the bottom end of the trailing sheet pile interlock of a second sheet pile with the top end of the leading sheet pile interlock of the first sheet pile, driving the second sheet pile into the ground, and then repeating the process to insert third, fourth etc sheet piles into the wall.

It is often necessary to seal the connection between two sheet piles. This is generally done by providing sealing means in at least one interlock chamber of the two interlocking sheet pile interlocks. In order to ensure good sealing conditions, it is important to keep ground material out of the interlock chambers.

Sometimes it is also necessary to interlock two interconnected sheet pile against longitudinal shifting relative to one another. This can be achieved e.g. by bonding the interlocked sheet pile interlocks with an adhesive or cement. In order to ensure good bond conditions, it is important to keep ground material out of the interlock chambers.

Several methods have been proposed for keeping ground material out of the interlock chambers.

EP-0 628 662 teaches to keep the ground material out of the interlock chamber by introducing a steel tube into the interlock chamber of the leading sheet pile interlock or, alternatively, by filling this chamber with a polyethylene tube. In order to be effective, such a tube must closely fit into the interlock chamber. It follows that it is not easy to withdraw the tube from the interlock chamber prior to driving the next sheet pile. This is in particular true, because the leading sheet pile interlock may be slightly deformed when driven into the ground and because ground particles entering between the tube and the wall of the sheet pile interlock increase friction.

According to EP-0 341 194, a caliber piece, which has substantially the same shape as a sheet pile interlock, is interconnected with a leading sheet pile interlock for blocking off the longitudinal opening of the interlock chamber from the outside. Once the sheet pile is driven into the ground, the caliber piece is extracted. Although the interlock chamber is rather well protected from soil, the removal of the caliber piece over the whole length of the sheet pile is not easy.

Similarly, according to GB-2 322 658 a steel conduit is inserted into the interlock chamber. The conduit has a cover attached to it, which blocks off the longitudinal opening of the interlock chamber from the outside. The interlock chamber is rather well protected from soil, but it is very difficult to withdraw the long and rigid conduit-cover assembly from the interlock chamber.

In accordance with EP-0 722 017 the interlock chamber of the leading sheet pile interlock is protected by means of a deformable strip, which is welded with one of its longitudinal edges to the sheet pile, so as to cover the longitudinal opening of the interlock chamber. A major disadvantage of this method is that the deformable strip is easily damaged and torn off when the sheet pile is driven into the ground.

SUMMARY OF THE INVENTION

The technical problem underlying the present invention is to provide a method for driving a sheet pile into the ground, wherein the interlock chamber in the sheet pile interlock is well protected from ground material by an obturating device that is easy to introduce and easy to withdraw from the interlock chamber. This problem is solved by a method as claimed in claim 1.

In accordance with the method of the present invention an obturating device comprising an inflatable tube is inserted into the interlock chamber of the sheet pile interlock to be protected. Once the obturating device is in place within the interlock chamber, its inflatable tube is inflated, so that the obturating device effectively closes the opening to the interlock chamber. It follows that no ground material can enter the interlock chamber while the sheet pile is being driven into the ground. Once the sheet pile is in place, the inflatable tube is again deflated, and the obturating device can be easily withdrawn from the interlock chamber. In short, while the inflatable tube is inflated, the obturating device ensures excellent protection for the interlock chamber against ground material, and while the inflatable tube is deflated, the obturating device can be easily inserted into or withdrawn from the interlock chamber.

In accordance with a preferred embodiment, inflation of the inflatable tube pushes an obturating block into the longitudinal opening of the interlock chamber. This obturating block closes the longitudinal opening of the interlock chamber. It will be appreciated that the obturating block can be made stronger than the inflatable tube and is hence less likely to be damaged during the driving process. It is preferably a semi-rigid body, because such a semi-rigid body may be more easily introduced in and withdrawn from the interlock chamber. Furthermore, it is preferably a wedge shaped body engaging the longitudinal opening of the interlock chamber. The wedge shape ensures that, when the inflatable tube is inflated, the obturating block centres itself in the longitudinal opening of the interlock chamber so as to effectively obturate this opening from the inside of the interlock chamber. It is not excluded to conceive the obturating block as a separate piece, but is preferred to firmly attach it to the inflatable tube and, in particular, to form it in one piece with the inflatable tube. The fact that the inflatable tube and obturating block are firmly attached together allows for easy manipulation on the building site.

The obturating device can further comprise a flexible tube with an open front end alongside the inflatable tube which has a closed front end. This flexible tube can then be used for filling the interlock chamber with sand or synthetic foam (as e.g. a PU foam) while the obturating device is withdrawn from the interlock chamber. Especially in case the sheet piles are driven into light or muddy ground material, it is advantageous to fill the interlock chamber with sand or synthetic foam material in order to prevent light or muddy ground material to enter the interlock chamber once the obturating device has been withdrawn. It is not excluded to conceive the flexible tube as a separate piece, but is preferred to firmly attach it to the inflatable tube and, in particular, to form it in one piece with the inflatable tube.

In particular, when constructing a sheet pile wall, the obturating device is inserted into the interlock chamber of the leading sheet pile interlock of a first sheet pile. The inflatable tube is inflated, e.g. by means of compressed air, and this first sheet pile is driven into the ground. Once this first sheet pile is in place, the inflatable tube is deflated and the obturating device is withdrawn from the interlock chamber. It will be appreciated that the withdrawn obturating device leaves an interlock chamber in the leading sheet pile interlock that is perfectly clean, i.e. free from any ground material. The obturating device is then inserted into the interlock chamber of the leading sheet pile interlock of a second sheet pile and the inflatable tube is inflated. The bottom end of the trailing sheet pile interlock of the second sheet pile is now interconnected with the top end of the leading sheet pile interlock of the first sheet pile. As the second sheet pile is driven into the ground, its trailing sheet pile interlock slides down through the clean interlock chamber of the leading sheet pile interlock of the first sheet pile. Once the sheet pile is in place, the inflatable tube is again deflated and the obturating device withdrawn. This process is repeated for the third, fourth, fifth, etc sheet piles. Consequently, the trailing sheet pile interlock of a sheet pile is always interconnected with a clean leading sheet pile interlock of the preceding sheet pile.

Before driving a sheet pile into the ground, it is recommended to insert a front end obturator in the bottom end of the interlock chamber of a leading sheet pile interlock. The front end obturator displaces ground material from under the axial opening of the interlock chamber and prevents ground material from axially entering the interlock chamber. It will be appreciated that the front end obturator can e.g. be a simple bolt. However, in order to be most effective, the front end obturator advantageously has a conical head. The front end obturator is preferably just inserted into the interlock chamber, rather than fixed to the sheet pile, so that the front end obturator can simply be pushed out of the interlock chamber of the leading sheet pile interlock by the trailing sheet pile interlock of the subsequent sheet pile. This is of particular interest in case a sheet pile needs to be driven deeper into the ground than the preceding one.

An adhesive is preferably applied onto the trailing sheet pile interlock of the second sheet pile before interlocking it with the leading sheet pile interlock of the first sheet pile. Thus, the connection joint between two sheet piles is interlocked against longitudinal shifting relative to one another. A spreader can be used for applying the adhesive onto the trailing sheet pile interlock. By using such a spreader, the adhesive is applied onto the trailing sheet pile interlock uniformly over the whole length of the sheet pile.

A sealant can also be applied onto the trailing sheet pile interlock of the second sheet pile before interlocking it with the leading sheet pile interlock of the first sheet pile. Thus, the connection joint between two sheet piles is sealed, and the sheet pile wall can thereby be rendered waterproof. As ground material is kept out of the interlock chambers, excellent sealing conditions between two sheet piles are ensured.

A short cleaning piece is preferably engaged with the leading sheet pile interlock of a first sheet pile before interconnecting this interlock with the trailing sheet pile interlock of a second sheet pile. When the second sheet pile is driven into the ground, its trailing sheet pile interlock pushes the cleaning piece along the leading sheet pile interlock of the first sheet pile. It will be appreciated that the cleaning piece can e.g. be a piece of an interlocking sheet pile interlock, which removes any ground material from the inner walls of the leading sheet pile interlock and preferably wraps the outer walls of the leading sheet pile interlock, so that it also effectively removes any ground material from the outer walls of the leading sheet pile interlock. It follows that all exterior and interior contact surfaces of the leading sheet pile interlock are free of ground material when coming into contact with the corresponding contact surfaces of the trailing sheet pile interlock of the subsequent sheet pile. Usage of the cleaning piece is particularly of advantage if the interlock chamber of the leading sheet pile interlock of the first sheet pile has been filled with sand while the obturating device was withdrawn from the interlock chamber.

The present invention also concerns a device for obturating an interlock chamber of a sheet pile interlock to be used with the method described above. Such an obturating device comprises an inflatable tube arranged in the interlock chamber and a wedge shaped obturating block associated with the inflatable tube.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
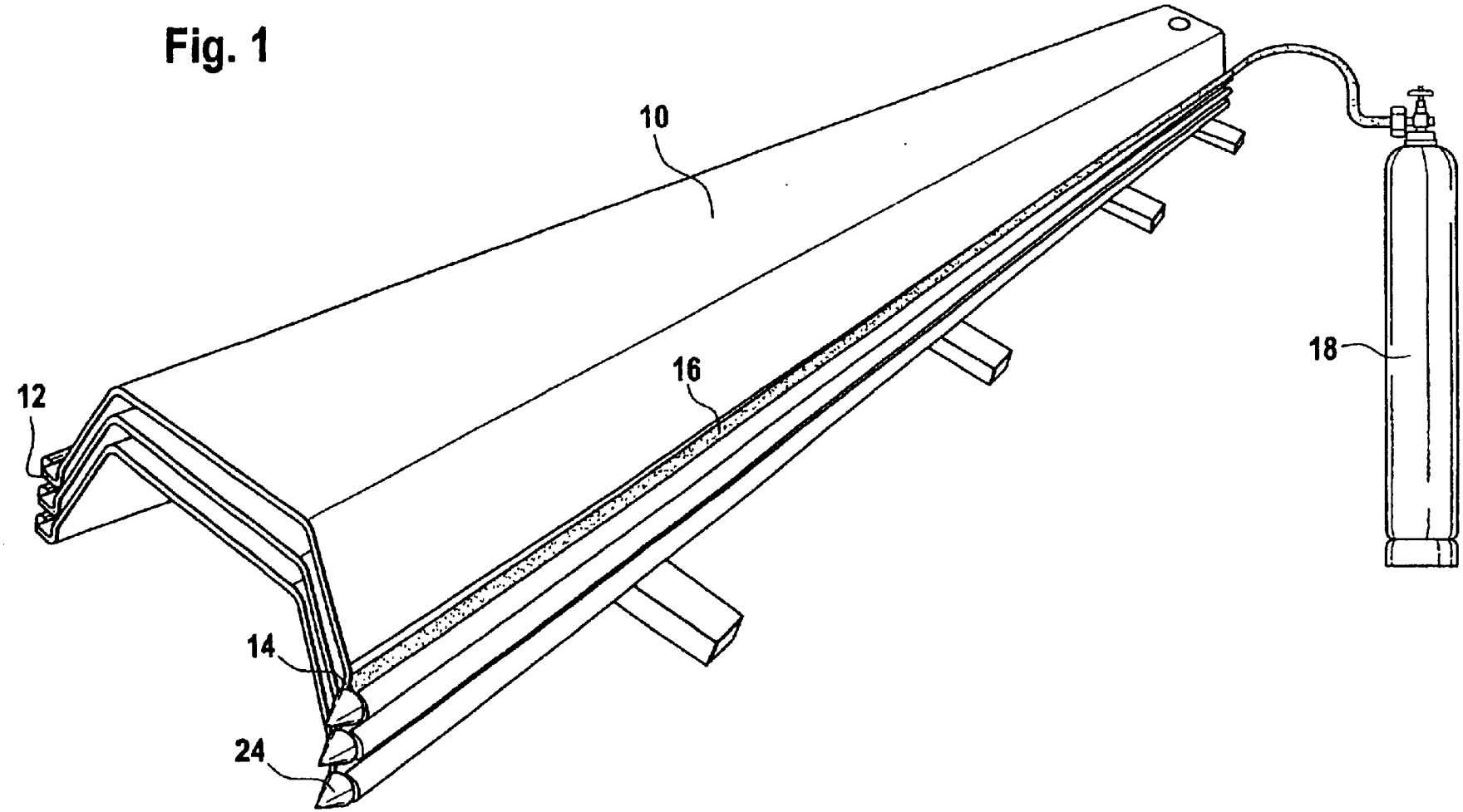
FIG. 1: is a perspective view of three sheet piles horizontally placed on the ground.

FIG. 1 shows some sheet piles 10 horizontally placed on the ground at the work site. The longitudinal edges of the sheet pile 10 comprise a trailing 12 and a leading sheet pile interlock 14. An obturating device 16 is inserted in the leading sheet pile interlock 14 and inflated by compressed air means 18.

Figure 2:
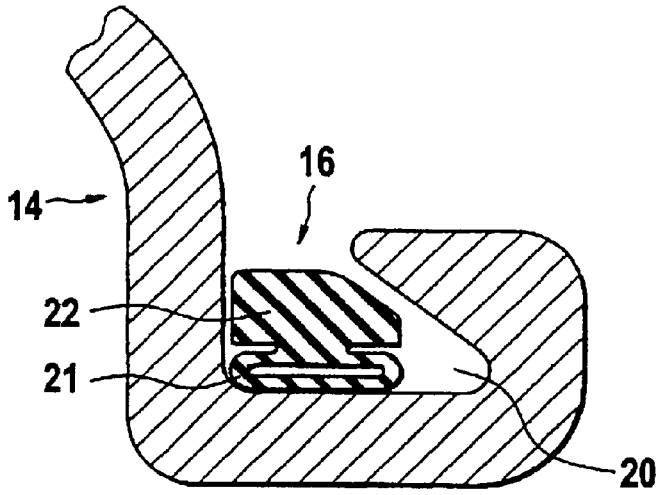
FIG. 2: is a section through a deflated obturating device inside a sheet pile interlock.
Figure 3:
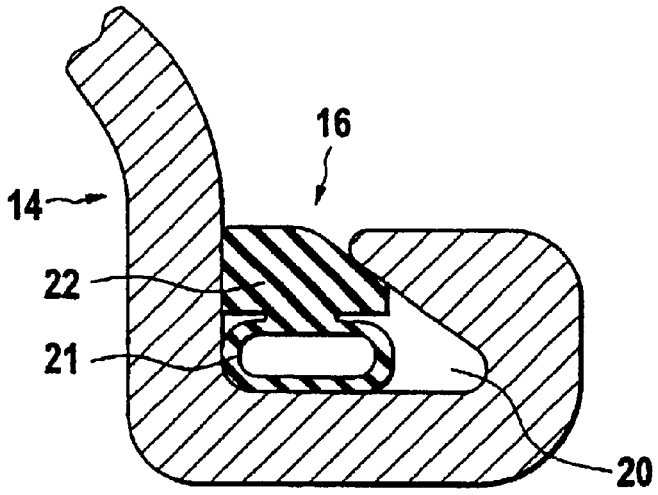
FIG. 3: is a section through an inflated obturating device inside a sheet pile interlock.

The obturating device 16 is described in more detail by referring to FIGS. 2 and 3. The hook-shaped leading sheet pile interlock 14 comprises an interlock chamber 20, in which the obturating device 16 is arranged. The obturating device 16 comprises an inflatable tube 21 and a wedge shaped obturating block 22. FIGS. 2 and 3 show the inflatable tube 21 in its deflated and inflated state respectively. When the inflatable tube 21 is inflated, the obturating block 22 is firmly pressed in the longitudinal opening, which gives access to the guiding chamber 20. In other words, it blocks off this longitudinal opening of the interlock chamber 20, thereby preventing ground material from entering into the interlock chamber 20 through this opening.

Figure 4:
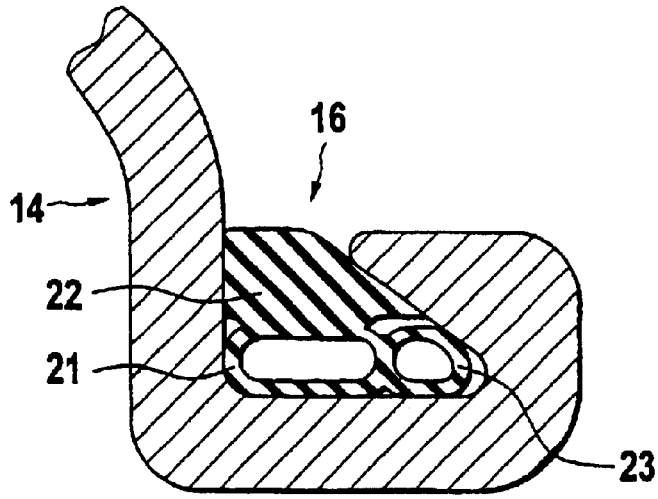
FIG. 4: is a section through an inflated obturating device with flexible tube inside a sheet pile interlock.

FIG. 4 shows an obturating device 16 having a flexible tube 23 running alongside the inflatable tube 21. The flexible tube 23 has an open front end and is used to insert sand into the interlock chamber 20 when the obturating device 16 is being removed from the interlock chamber 20. The longitudinal opening of the interlock chamber 20 is thereby blocked off, whence preventing light or muddy ground material from entering into the interlock chamber 20 through this opening.

It will be noted that the preferred obturating device 16 shown in FIGS. 2 and 3 and in FIG. 4 is a semi-rigid rubber piece. It may include synthetic or metallic reinforcement fibres or fabrics, which increase its tensile strength. Its surfaces coming into contact with the walls of the sheet pile interlock may receive a friction reducing coating.

Figure 5:
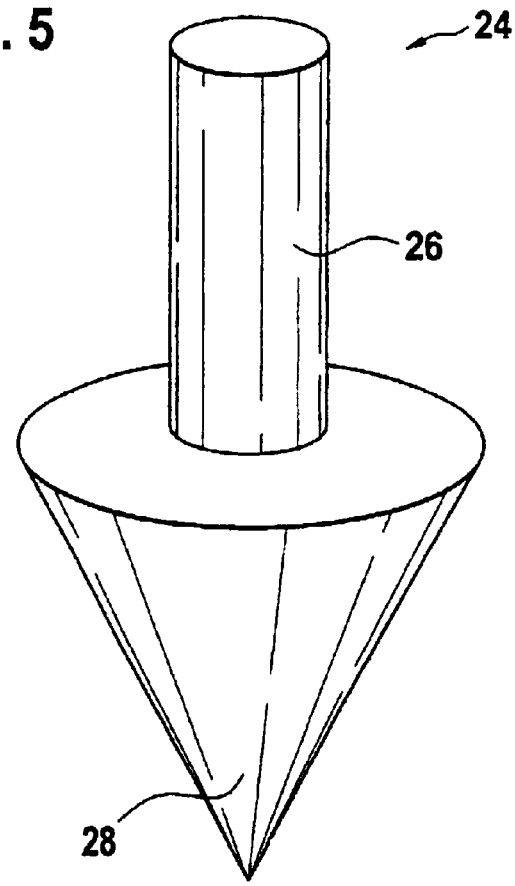
FIG. 5: is a perspective view of a front end obturator.
Figure 6:
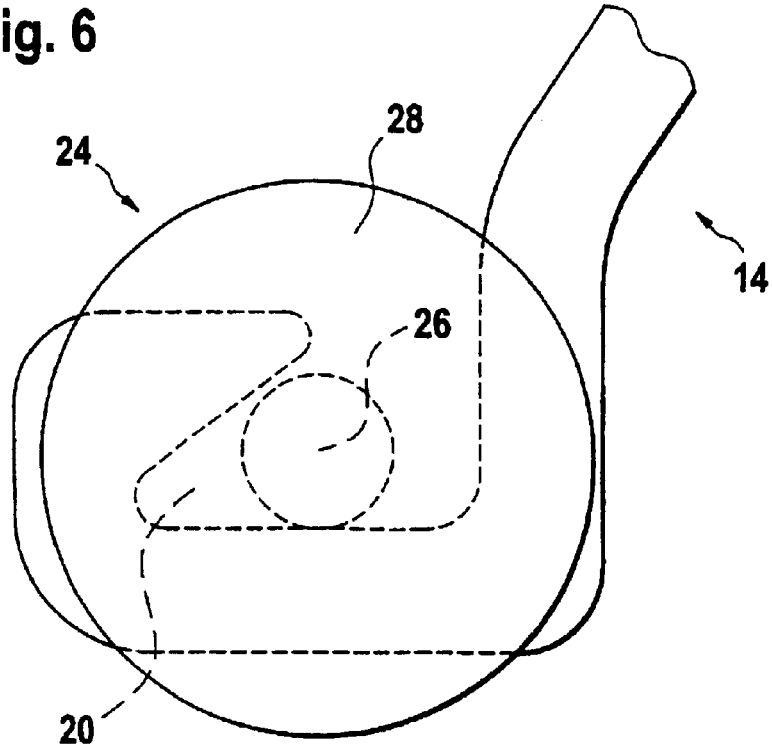
FIG. 6: is a schematic underneath view of the front end obturator of FIG. 5 inserted in a sheet pile interlock.

In order to protect the interlock chamber 20 from soil being pushed in axially from below as the sheet pile 10 is being driven, a front end obturator 24 is inserted in the bottom end of the interlock chamber 20. The front end obturator 24 shown in FIGS. 5 and 6 has a cylindrical body 26 and a conical head 28.

Figure 7:
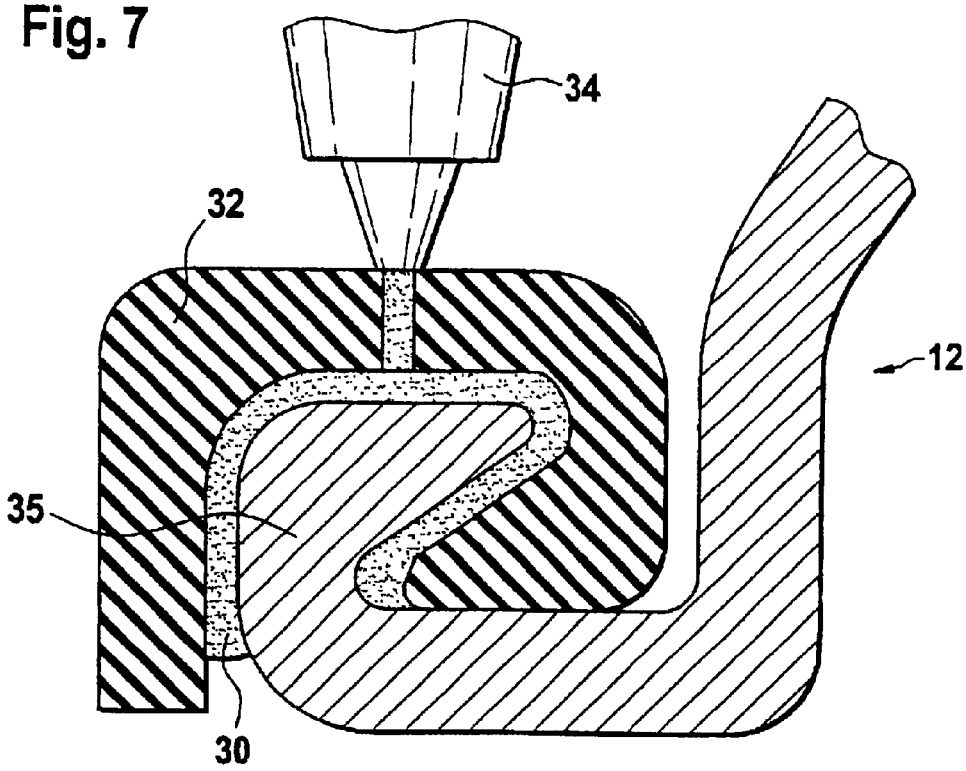
FIG. 7: is a section through a sheet pile interlock on which adhesive is being applied.

FIG. 7 shows a trailing sheet pile interlock 12 on which adhesive 30 is being applied. The adhesive 30 is being injected through a spreader 32 by means of a nozzle 34. The spreader 32 has a cavity that has substantially the same form as the head 35 of a sheet pile interlock, but is slightly bigger than the latter, so that a uniform adhesive layer 30 is applied over the whole length of the head 35 of the trailing sheet pile interlock 12.

Figure 8:
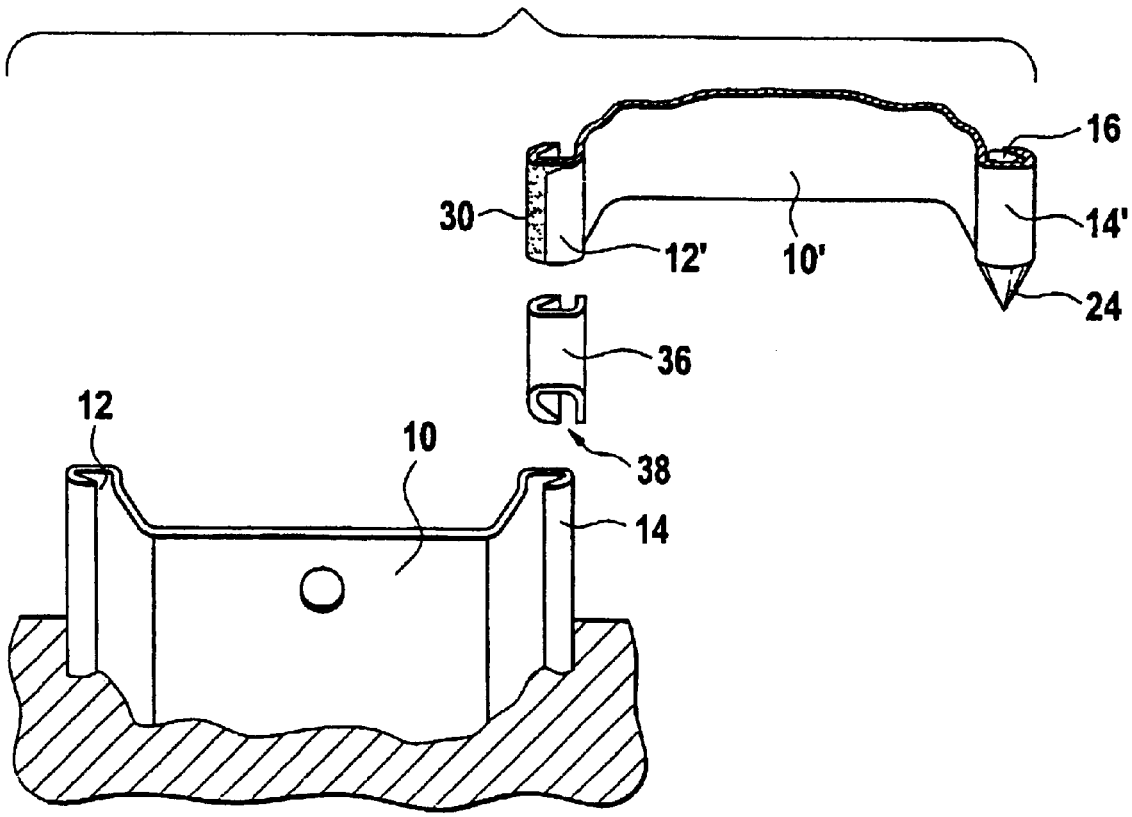
FIG. 8: is a perspective view of two sheet piles being interconnected.

On FIG. 8, a first sheet pile 10 with its trailing and leading sheet pile interlocks 12, 14 can be seen in place in the ground. A second sheet pile 10' has an adhesive 30 applied on its trailing sheet pile interlock 12' and the obturating device 16 and the front end obturator 24 inserted in its leading sheet pile interlock 14'. Before the second sheet pile 10' is interlocked with the first sheet pile 10 and driven into the ground, a short cleaning piece 36 is engaged in the leading sheet pile interlock 14 of the first sheet pile 10 for removing any ground material from the inner walls of the leading sheet pile interlock 14. The cleaning piece 36 shown in FIG. 8 wraps the outer walls of the leading sheet pile interlock 14 and has an acute front end 38. Consequently, when it is pushed down along the leading sheet pile interlock 14 by the trailing sheet pile interlock 12' of the second sheet pile 10', it effectively removes any ground material from the outer walls of the leading sheet pile interlock 14.

What is claimed is:

1. A method for driving a sheet pile into the ground, comprising the steps of:

a) providing a sheet pile including at least one sheet pile interlock, wherein a longitudinal opening gives access to an interlock chamber in said at least one sheet pile interlock;

b) inserting an obturating device into said interlock chamber, said obturating device comprising an inflatable tube;

c) inflating said inflatable tube so that said obturating device closes said longitudinal opening giving access to said interlock chamber;

d) driving said sheet pile into the ground, wherein said obturating device prevents ground material from penetrating through said longitudinal opening into said interlock chamber;

e) deflating said inflatable tube; and f) withdrawing said obturating device from said interlock chamber.

2. The method according to claim 1, wherein said obturating device comprises an obturating block, and step c) consists in inflating said inflatable tube so that said obturating block is pushed into said longitudinal opening of said interlock chamber.

3. The method according to claim 2, wherein said obturating block is a wedge shaped body.

4. The method according to claim 2, wherein said obturating block is a semirigid body.

5. The method according to claim 2, wherein said inflatable tube and said obturating block are formed in one piece.

6. The method according to claim 2, wherein said obturating device further comprises a flexible tube alongside said inflatable tube, and step f) comprises:

filling said interlock chamber with sand through said flexible tube while withdrawing said obturating device from said interlock chamber.

7. The method according to claim 6, wherein said inflatable tube, said obturating block and said flexible tube are formed in one piece.

8. A method for driving sheet piles into the ground, comprising the steps of:

a) providing a first sheet pile including a leading sheet pile interlock, wherein a longitudinal opening gives access to an interlock chamber in said leading sheet pile interlock;

b) inserting an obturating device into said interlock chamber, said obturating device comprising an inflatable tube;

c) inflating said inflatable tube so that said obturating device closes said longitudinal opening giving access to said interlock chamber;

d) driving said first sheet pile into the ground, wherein said obturating device prevents ground material from penetrating through said longitudinal opening into said interlock chamber;

e) deflating said inflatable tube; and f) withdrawing said obturating device from said interlock chamber;

g) providing a second sheet pile including a trailing sheet pile interlock; and h) driving said second sheet pile into the ground so that said trailing sheet pile interlocks with said leading sheet pile interlock.

9. The method according to claim 8, further comprising the step of:

inserting a front end obturator in the bottom end of said interlock chamber of said leading sheet pile interlock before driving said first sheet pile into the ground.

10. The method according to claim 8, further comprising the step of:

applying an adhesive onto said trailing sheet pile interlock of said second sheet pile before driving the latter into the ground.

11. The method according to claim 10, wherein a spreader is used to apply said adhesive onto said trailing sheet pile interlock.

12. The method according to claim 8, further comprising the step of:

applying a sealant onto said trailing sheet pile interlock of said second sheet pile before driving the latter into the ground.

13. The method according to claim 12, wherein a spreader is used to apply said sealant onto said trailing sheet pile interlock.

14. The method according to claim 8, further comprising the step of:

inserting a cleaning piece into said leading sheet pile interlock of said first sheet pile before interlocking it with said trailing sheet pile interlock of said second sheet pile.

15. A sheet pile comprising:

at least one sheet pile interlock, wherein a longitudinal opening gives access to an interlock chamber in said at least one sheet pile interlock; and an obturating device arranged in said interlock chamber, said obturating device comprising an inflatable tube closed at one end, wherein, when inflated, said obturating deice closes said longitudinal opening;

further comprising a flexible tube with an inlet opening at one end thereof and an outlet opening at the other end thereof, said flexible tube for filling said interlock chamber with sand.

16. The sheet pile according to claim 15, wherein said obturating device comprises an obturating block associated with said inflatable tube.

17. The sheet pile according to claim 16, wherein said obturating block is a wedge shaped body.

18. The sheet pile according to claim 17, wherein said wedge shaped obturating block is a semi-rigid body.

19. The sheet pile according to claim 16, wherein said inflatable tube and said obturating block are formed in one piece.

20. The sheet pile according to claim 15, wherein said inflatable tube, said obturating block and said flexible tube are formed in one piece.

* * * * *

UNITED STATES PATENT AND TRADEMARK OFFICE

CERTIFICATE OF CORRECTION

PATENT NO. : 6,769,841 B2
DATED : August 3, 2004
INVENTOR(S) : Jean-Michel Moulin et al.

It is certified that error appears in the above-identified patent and that said Letters Patent is hereby corrected as shown below:

Column 7,
Line 12, after "rating", please delete "deice" insert -- device --.

Signed and Sealed this

First Day of February, 2005

JON W. DUDAS
*Director of the United States Patent and Trademark Office*